US005739473A

United States Patent [19]

Zerbs

[11] Patent Number: 5,739,473

[45] Date of Patent: Apr. 14, 1998

[54] FIRE RESISTANT CABLE FOR USE IN LOCAL AREA NETWORK

[75] Inventor: Stephen Taylor Zerbs, Gretna, Nebr.

[73] Assignee: Lucent Technologies Inc., Murray Hill, N.J.

[21] Appl. No.: 509,282

[22] Filed: Jul. 31, 1995

[51] Int. Cl.[6] ..... H01B 11/02

[52] U.S. Cl. ..... 174/121 A; 174/110 PM

[58] Field of Search ..... 174/121 A, 113 R, 174/110 PM, 110 R, 110 SR, 110 FC; 385/109

[56] References Cited

U.S. PATENT DOCUMENTS

| | | | |
|---|---|---|---|
| 4,284,842 | 8/1981 | Arroyo et al. | 174/107 |
| 4,412,094 | 10/1983 | Dougherty et al. | 174/110 |
| 4,605,818 | 8/1986 | Arroyo et al. | 174/107 |
| 4,941,729 | 7/1990 | Hardin et al. | 174/107 |
| 4,969,706 | 11/1990 | Hardin et al. | 174/121 A |
| 5,001,304 | 3/1991 | Hardin et al. | 174/121 A |
| 5,010,210 | 4/1991 | Sidi et al. | 174/113 R |
| 5,074,640 | 12/1991 | Hardin et al. | 385/109 |
| 5,149,915 | 9/1992 | Brunker et al. | 174/113 R |
| 5,155,789 | 10/1992 | Le Noane et al. | 385/106 |
| 5,162,609 | 11/1992 | Adriaenssens et al. | 174/34 |
| 5,173,960 | 12/1992 | Dickinson | 174/121 A |
| 5,202,946 | 4/1993 | Hardin et al. | 385/109 |
| 5,326,638 | 7/1994 | Mottine, Jr. et al. | 174/110 R |
| 5,424,491 | 6/1995 | Walling et al. | 174/113 R |
| 5,493,071 | 2/1996 | Newmoyer | 174/113 R |
| 5,576,515 | 11/1996 | Bleich et al. | 174/110 PM |
| 5,600,097 | 2/1997 | Bleich et al. | 174/110 R |

*Primary Examiner*—Kristine L. Kincaid
*Assistant Examiner*—Marc D. Machtinger

[57] ABSTRACT

The preferred embodiment of the cable disclosed includes seven groups of twisted-pairs, outlined in dashed lines in FIG. 1. Groups 12, 14, 17 and 19 have four pairs each, and groups 13, 16 and 18 have three pairs each. Six of the groups, namely 12, 13, 14, 16, 17 and 18 are referred to herein as the outer groups since they are collectively twisted and wound helically about the seventh group 19 which is centrally located throughout the length of the cable. Each of the groups of twisted pairs may be held together by a cable binder such as nylon yarn 22. The core thus formed is enclosed within a jacket 23, and the entire assembly is referred to in the art as a "honeycomb" structure. In accordance with the present invention, the twisted pairs of each of the six outer groups are insulated with a fluorinated ethylene-propylene copolymer (FEP) material such as, for example, Teflon®, while the twisted pairs of the central group are insulated with a high density polyethylene (HDPE) material. Both the FEP material and the HDPE material have the low dissipation factor and low dielectric constant mentioned heretofore, which insures optimum electrical performance, especially at high frequencies. In addition, both materials present a smooth surface of substantially uniform thickness, approximately six (6) to ten (10) mils, thereby insuring a low structural return loss (SRL).

14 Claims, 1 Drawing Sheet

FIRE RESISTANT CABLE FOR USE IN LOCAL AREA NETWORK

TECHNICAL FIELD

This invention relates to fire-resistant multi-pair telecommunications cables (backbone cables) for transmitting high frequency signals and, more particularly, to such a cable for use in plenum and riser cable applications.

BACKGROUND OF THE INVENTION

In many buildings, most particularly office buildings, the room ceiling on each floor is usually spaced below the structural floor panel of the next higher floor and is referred to as a drop ceiling. This spacing creates a return air plenum often used for the building's heating and cooling systems, and generally is continuous throughout the entire length and breadth of the floor.

If a fire occurs within a room or rooms on a floor and below the drop ceiling, it may be contained by the walls, ceiling, and floor of the room. On the other hand, if the fire reaches the plenum it can spread at an alarming rate, especially, if, as is often the case, flammable materials are located within the plenum. Inasmuch as the plenum is a convenient place to route wires and cables, both electrical power and communication types, unless these wires and cables are flame and smoke retardant they can contribute to the rapid spread of fire and smoke throughout the floor and, worse, throughout the building.

As a result of the potential danger presented by flammable insulation of wires and cables, the National Electric Code (NEC) has prohibited the use of electrical cables in plenums unless they are enclosed in metal conduits. Such metal conduits are difficult to route in plenums congested with other items or apparatus, and where, for example, it is desirable or necessary to rearrange the office and its communications equipment, computers, and the like, the re-routing of the conduits can become prohibitively expensive. As a consequence, the NEC permits certain exceptions to the metal conduit requirement. Where, for example, a cable is both flame resistant and low smoke producing, the conduit requirement is waived provided that the cable, in tests, meets or exceeds the code's requirement for flame retardation and smoke suppression. Such tests must be conducted by a competent authority such as the Underwriters Laboratory Inc. In particular, for cables to be appropriately plenum rated, they are currently subjected to a plenum burn test identified as UL-910.

The danger of the spread of fire is also at issue in those cases where the communications cable extends from floor to floor, in which case it is referred to as a riser cable. This riser cable is often extended upward or downward for more than two stories. Therefore, Underwriters Laboratories Inc., as with plenum cables, performs stringent tests to verify that the cable will perform satisfactorily. At present, this includes a riser burn test (UL-1666) in order to establish a CMR rating for communications cable used in riser and general purpose applications.

There are several communication cable designs presently available which perform satisfactorily in riser and/or plenum applications, i.e. meeting both the electrical requirements and the flame-spread and smoke-suppression requirements. In the prior art, data and other signal transmission has been carried out on cables in which the conductors are insulated with, for example, polyvinyl chloride (PVC). However, such cables too often result in transmission losses which are undesirably high for the transmission of high frequency signals. As a consequence, various alternative cable structures, using various types of materials, have been tried.

In U.S. Pat. No. 4,284,842 of Arroyo et al., there is shown one such cable in which the multi-conductor core is enclosed in an inorganic sheath which is, in turn, enclosed in a metallic sleeve. The metallic sleeve is surrounded by dual layers of polyimide tape. The inorganic sheath resists heat transfer into the core, and the metallic sheath reflects radiant heat. Such a cable effectively resists fire and produces low smoke emission, but requires three layers of jacketing material. Another example of a multilayer jacket is shown in U.S. Pat. No. 4,605,818 of Arroyo. In U.S. Pat. No. 5,074,640 of Hardin et al., there is disclosed a cable for use in plenums or riser shafts, in which the individual conductors are insulated by a non-halogenated plastic composition which includes a polyetherimide constituent and an additive system. The jacket includes a siloxane/polyimide copolymer constituent blended with a polyetherimide constituent and an additive system, including a fire-retardant system. In U.S. Pat. No. 4,412,094 of Dougherty et al., a cable is disclosed wherein each of the conductors is surrounded by two layers of insulation. The inner layer is a polyolefin plastic material expanded to a predetermined percentage, and the outer layer comprises a relatively fire-retardant material. The core is enclosed in a metallic jacket and a fire-resistant material. While such a cable meets the requirements for fire resistance and low smoke, the metallic jacket represents an added cost element in the production of the cable. In U.S. Pat. No. 5,162,609 of Adriaenssens et al., there is shown a fire-resistant cable in which the metallic jacket member is eliminated. In that cable, each conductor of the several pairs of conductors has a metallic, i.e., copper center member surrounded by an insulating layer of solid, low density polyethylene which is, in turn, surrounded by a flame-resistant polyethylene material. The core, i.e., all of the insulated conductors, is surrounded by a jacket of flame-retardant polyethylene.

At the present time, many communications cables that are commercially available use a tetra-flouoro ethylene/hexafluro propylene copolymer (FEP) as insulation for the individual wires forming the pairs, and a jacket of fluoropolymer material such as a copolymer of ethylene and clorotrifluoroethylene (ECTFE). The FEP material most commonly used is Teflon® TE4100, manufactured by DuPont, and an ECTFE material commonly used for the jacket is Halar® 985, supplied by Ausimont, U.S.A. FEP materials, such as Teflon®, are quite expensive and, at times, in limited or short supply, thereby making production of certain plenum cable design both expensive and limited as to quantity. In addition, Halar® 985, although excellent as to burn and smoke performance, is relatively stiff and often kinks, thereby making the cable somewhat difficult to route through any plenum and difficult to pull, and, the cable also is likely to be damaged when kinked. Examples of such cable designs are described in commonly-assigned U.S. patent applications Ser. Nos. 08/334,657 filed Nov. 4, 1994, and 08/383,135 filed Feb. 9, 1995.

Therefore, what is needed, and not offered by the prior art, is a communications cable design which maintains the flame spread and smoke suppressing requirements of plenum and riser-rated cables, but does so with a significant reduction in the use of FEP materials, such as Teflon®, that is both costly and scarce. The cable design must also satisfy all of the desired operational performance characteristics commonly applied to a communications cable.

SUMMARY OF THE INVENTION

The cable of the invention comprises seven groups of twisted-pairs, outlined in dashed lines in FIG. 1. Groups 12, 14, 17 and 19 have four pairs each, and groups 13, 16 and 18 have three pairs each. Six of the groups, namely 12, 13, 14, 16, 17 and 18 are referred to herein as the outer groups since they are collectively twisted and wound helically about the seventh group 19 which is centrally located throughout the length of the cable. Each of the groups of twisted pairs may be held together by a cable binder such as nylon yarn 22. The core thus formed is enclosed within a jacket 23, and the entire assembly is referred to in the art as a "honeycomb" structure.

In accordance with the present invention, the twisted pairs of each of the six outer groups are insulated with a fluorinated ethylene-propylene copolymer (FEP) material such as, for example, Teflon®, while the twisted pairs of the central group are insulated with a high density polyethylene (HDPE) material. Both the FEP material and the HDPE material have the low dissipation factor and low dielectric constant mentioned heretofore, which insures optimum electrical performance, especially at high frequencies. In addition, both materials present a smooth surface of substantially uniform thickness, approximately six (6) to ten (10) mils, thereby insuring a low structural return loss (SRL).

In general, FEP materials have excellent flame retardance as well as low smoke evolution characteristics. On the other hand, HDPE does not exhibit as high a level of flame retardance as FEP. To further enhance the fire retardance of the cable of the present invention, the groups of twisted pairs may be enclosed in a jacket comprised of a plasticized copolymer of ethylene and clorotrifluoroethylene material. Such a material, an example of which is commercially available as Halar®379, has a somewhat poorer burn performance than material without the plasticizer such as Halar® 985. As a result of its novel design, the cable of the present invention is more economical to produce than the designs of the prior art, in part, since it decreases dependence on costly and sometimes difficult to obtain materials, by eliminating Teflon® as insulation for some of the twisted pairs.

These and other features and advantages of the invention will be more readily apparent from the following detailed description read in conjunction with the accompanying drawings.

DETAILED DESCRIPTION

Figure 1:
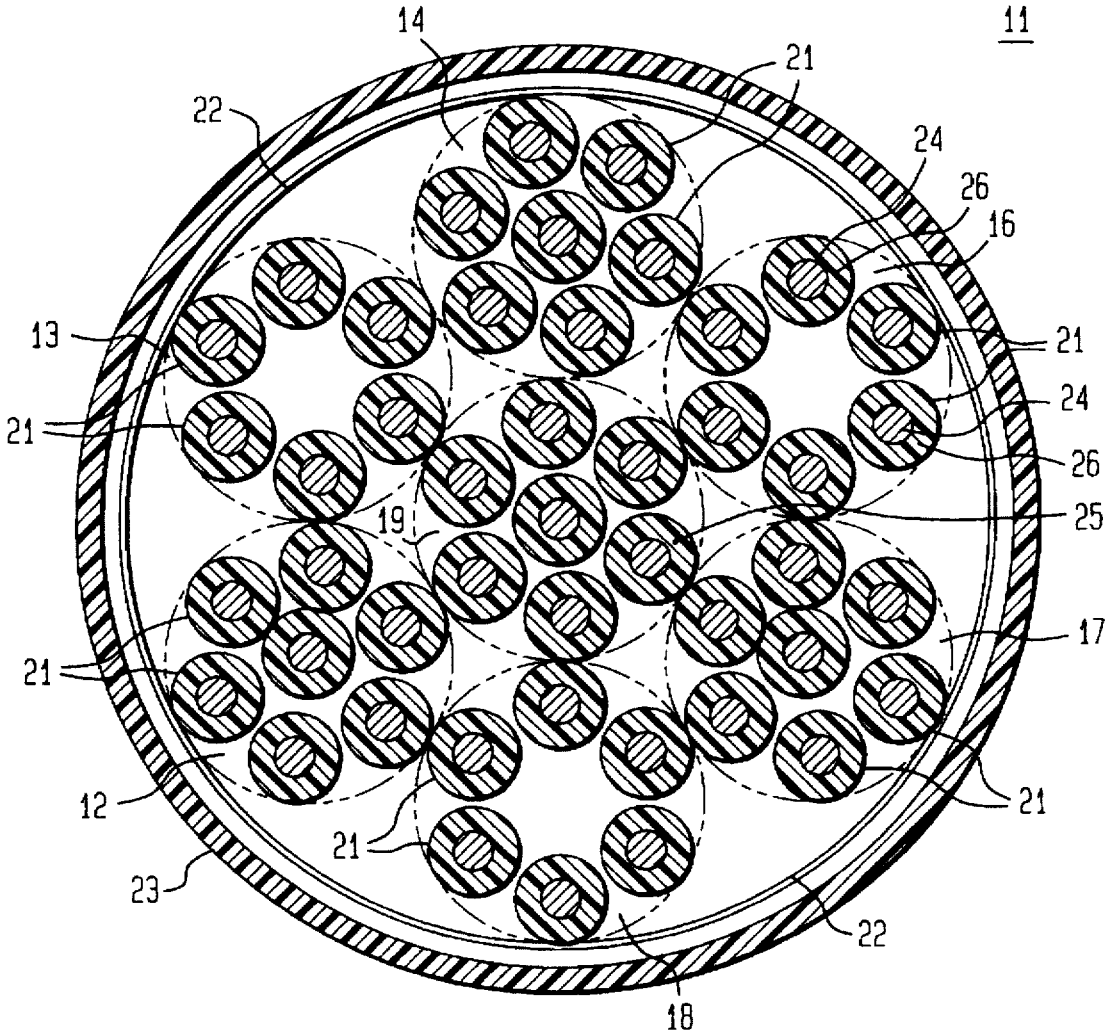
FIG. 1 is a cross-sectional view of the cable of the present invention.

In the preferred embodiment of the present invention, cable 11 of FIG. 1 comprises seven groups 12, 13, 14, 16, 17, 18 and 19 of twisted-pairs, outlined in dashed lines, each pair of insulated conductors being identified generally by the reference numeral 21. According to the one particular cable configuration shown, groups 12, 14, 17 and 19 include four pairs each, and groups 13, 16 and 18 include three pairs each. Within each group, the twist length of the pairs differs in order to minimize cross-talk, or inter-pair noise. Likewise, each of the groups has a helical twist, and the lay of the groups differs, being 3.4 inches in groups 12, 14 and 17; 4.1 inches in groups 13, 16 and 18, and 2.5 inches in group 19. These layers are intended as illustrative examples only, and it is recognized that others are possible. However, the different groups, especially those immediately adjacent to each other, should have different lays for best overall performance. The six outer groups, namely groups 12, 13, 14, 16, 17 and 18, are, in turn, twisted helically about group 19 which is centrally oriented throughout the length of the cable. Furthermore, the entire collection of groups or, if desired, each individual group may be held together by a cable binder such as nylon yarn 22. The core thus formed is enclosed within a jacket 23, and the entire assembly is referred to in the art as a "honeycomb" structure.

In accordance with the present invention, the conductors of the twisted pairs within the center group 19 are purposely insulated with a different material than the conductors of the twisted pairs of the six outer groups 12, 13, 14, 16, 17, and 18. In particular, each conductor 24 of a twisted pair 21 incorporated within the center group 19 is encased within an insulating sheath 25 of a polyolefin material such as high density polyethylene (HDPE). HDPE is a relatively tough dielectric material that can be uniformly extruded with a smooth outer surface, a relatively uniform thickness, and adhesion to the conductor 24 that is within allowable limits. Also, the single layer 25 of insulation results in an insulated conductor that is slightly smaller in overall diameter, and with less eccentricity, than the dual layers of insulation in the prior art, thereby enabling somewhat smaller cables of equal capacity. In the preferred embodiment of the present invention, the twenty-five twisted pairs have a conductor gauge from 18 to 28 AWG, and an insulation thickness of less than twelve mils (0.012 inches).

Contrary to the center group 19, in the preferred embodiment of the present invention, the conductors of the twisted pairs of the six outer groups 12, 13, 14, 16, 17, and 18 are encased in an insulating portion 26 formed of an FEP material. An example of a material acceptable for the present cable design is Teflon® TE-4100 having a low dissipation factor of approximately 0.001 or less at 1 MHz, and a low dielectric constant of approximately 1.9 or less at 1 MHz. In order for a non-shielded cable such as is shown in FIG. 1 to be capable of transmitting high frequency signals such as are encountered in the typical modern computer equipped office environment, a dissipation factor of 0.004 or less is desirable. Additionally, for low loss transmission of high frequency data signals, it is desirable that the insulation be characterized by a suitably low dielectric constant, i.e., less than 2.5 at 1 MHz. It can been seen that the twisted pairs 21—21 all have insulation portions 26—26 whose dissipation factor and dielectric constant are considerably lower than the stated upper limits.

Like the FEP material 26—26 of pairs 21—21, HDPE has a dissipation factor of approximately 0.001 or less at 1 MHz and a dielectric constant of approximately 2.3 or less at 1 MHz. Thus, the electrical performance of twisted pairs within center group 19 is comparable to that of pairs with any of the outer groups 12, 13, 14, 16, 17, and 18, and meets the requirements for a Category V cable.

The use of HDPE for the insulation of twisted pairs of the center group 19 results in savings in cable cost, inasmuch as HDPE costs approximately a factor of about seventeen less than Teflon®. More important, however, is the fact that HDPE is readily available whereas Teflon® is often difficult to obtain, especially in the quantities necessary for the production of large amounts of cable. In addition, HDPE has a much lower specific gravity than Teflon®, approximately 0.95 to Teflon's 2.1, which is also desirable.

However, as stated earlier, HDPE is less effective in flame retardance and smoke suppression than FEP; hence, it may be necessary, where the cable is to be used as a plenum cable, that the jacket 23 have sufficient flame-retardance and smoke-suppression characteristics sufficient to prevent the HDPE material from igniting, charring, generating undesired fumes or further fueling the fire. In accordance with the present invention, the jacket 23 which surrounds the cable core formed by the groups comprises a flouropolymer material, more specifically a copolymer of ethylene and clourotritlouroethylene (ECTFE) and plasticizer material, such as, for example, Halar® 379. The thickness of the jacket 23 is approximately 15 mils, for example, so that there will be sufficient flame retardation and smoke suppression without the sacrifice of the flexibility produced by combining the plasticizer with the ECTFE material. The thickness of the jacket is in the 10 to 16 mil range, 15 mils having been found to be excellent as to performance.

As stated earlier, HDPE is less fire retardant than FEP, and the practice in the prior art has been to use a treated insulating material or an insulating material that is normally fire retardant or, as pointed out in the foregoing, a composite insulation consisting of a minimum of two layers, at least one of which is fire retardant. In practice, with such materials, there has been consistent failure because of SRL, often exceeding ten percent (10%) of cable production. Obviously, the manufacture of such cables is not as economical as is to be desired. In order to further enhance the fire retardance of the cable of the invention, as depicted in FIG. 1, it may be desirable to also make the outer jacket 23 highly fire retardant.

Based on the particulars described above, the present invention sets forth a novel cable configuration which reduces the amount of FEP needed to manufacture a communications cable that exhibits a high level of fire retardance. Specifically, the present invention strategically positions at least one group 19 of twisted pairs insulated with HDPE inside a spiraled collection of outer groups 12, 13, 14, 16, 17 and 18 of twisted pairs insulated with FEP. Such an arrangement isolates the center group from the outer edge of the cable, thereby somewhat shielding it from the heat and/or flames of a fire. This shielding allows the center group to use the less expensive and more readily available, but less fire resistant, HDPE as the insulating material, instead of the more expensive and scarce FEP of the outer groups which will be in closer proximity to the fire.

It is to be understood that thicknesses stated for the insulation and the jacket are approximations, being subject to the normal manufacturing variations, but within the normal manufacturing tolerances.

In order for an unshielded cable to qualify as a plenum cable, it must be subjected to the Underwriters Laboratory Plenum Burn Test, UL 910, in which cable samples of a length of approximately twenty-four feet are arrayed on a cable tray within a fire-test chamber, with a total cable width of several samples being approximately twelve inches. A 300,000 BTU/hour flame with a 240 feet per minute air flow within the chamber is applied to and engulfs the first four and one-half feet of the cable, and the flame is applied for twenty minutes. In order for the cable to pass the burn test and qualify as a plenum cable, the flame cannot spread beyond an additional five feet.

The exit end of the chamber is fitted to a rectangular-to-round transition piece and a straight horizontal length of vent pipe. A light source is mounted along the horizontal vent pipe at a point approximately sixteen feet from the vent end of the transition section and the light beam therefrom is directed upwardly and across the interior of the vent pipe. A photoelectric cell is mounted opposite the light source to define a light path length transversely through the vent pipe of approximately thirty-six inches, of which approximately sixteen inches are taken up by the smoke in the vent pipe. The output of the cell is directly proportional to the amount of light received from the light source, and provides a measure of light attenuation within the vent resulting from smoke, particulate matter, and other effluents. The output of the photoelectric cell is connected to a suitable recording device which provides a continuous record of smoke obscuration as expressed by a dimensionless parameter, optical density, given by the equation:

$$\text{Optical Density} = \log_{10}(T_i/T) \quad (1)$$

where $T_i$ is the initial light transmission through a smokeless vent pipe, and T is the light transmission in the presence of smoke in the vent pipe. The maximum optical density permissible is 0.5, and the average optical density cannot exceed 0.15.

The UL Test 1666, known as a vertical tray test is used by Underwriters Laboratories to determine whether a cable is acceptable as a riser cable. In that test, a sample of cable is extended upward from a first floor along a ladder arrangement having spaced rungs. A test flame producing approximately 527,500 BTU per hour, fueled by propane at a flow rate of approximately 211±11 standard cubic feet per hour, is applied to the cable for approximately thirty minutes. The maximum continuous damage height to the cable is then measured. If the damage height to the cable does not equal or exceed twelve feet, the cable is given a CMR rating approval for use as a riser cable.

The principles and features of the present invention have been shown and discussed in detail in an illustrative embodiment thereof. Various modifications may occur to workers in the art without departure from the spirit and scope of the invention.

I claim:

1. A fire-retardant telecommunications cable, comprising:

a core consisting of a plurality of insulated conductors in groups of twisted pairs, wherein the groups of twisted pairs are configured such that at least one of the groups of twisted pairs is positioned as a central group within the remaining outer groups of twisted pairs;

each of said conductors of the at least one central group having an insulating layer made of a material different than the insulating layer of the conductors of the outer groups; and a jacket of fire-retardant material surrounding said core.

2. The cable as claimed in claim 1 wherein the insulating layers of the conductors within the at least one central group comprise a single, relatively uniform layer of a non-fire-retardant polyolefin composition.

3. The cable as claimed in claim 2 wherein said non-fire-retardant polyolefin composition insulating the conductors of the at least one central group of twisted pairs comprises polyethylene.

4. The cable as claimed in claim 3 wherein said non-fire-retardant polyolefin composition insulating the conductors of the at least one central group of twisted pairs comprises high density polyethylene.

5. The cable as claimed in claim 1 wherein the insulating layers of the conductors within the plurality of outer groups comprise a single, relatively uniform layer of a fluoropolymer composition.

6. The cable as claimed in claim 5 wherein said fluoropolymer composition insulating the conductors within the plurality of outer groups of twisted pairs comprises a fluorinated ethylene-propylene copolymer.

7. The cable as claimed in claim 1 wherein each of said groups of conductors contains a plurality of twisted pairs of conductors twisted with respect to each other as a group, the twisted pairs of the groups having two or more different lay lengths.

8. The cable as claimed in claim 1 wherein said cable comprises twenty-five twisted pairs arranged such that the remaining outer groups include at least three groups which are twisted helically about the at least one central group.

9. The cable as claimed in claim 1 wherein each of the conductors in each of the twisted pairs has a gauge of from 18 to 28 AWG.

10. The cable as claimed in claim 1 wherein the insulating layer of each of the conductors has a thickness of less than about 12 mils.

11. The cable as claimed in claim 1 wherein the jacket has a thickness in the range of 10 to 16 mils.

12. The cable as claimed in claim 1 having a fire-retardant capability sufficient for use as a riser cable.

13. The cable as claimed in claim 1 having a fire-retardant capability sufficient for use as a plenum cable.

14. The cable as claimed in claim 1 wherein said cable is a UL-designated Category V cable.

* * * * *